US005588454A

United States Patent [19]

Kou

[11] Patent Number: 5,588,454

[45] Date of Patent: Dec. 31, 1996

[54] DUAL LOCKING MECHANISM FOR USE IN UMBRELLA HANDLES

[76] Inventor: Chin S. Kou, No. 27-1, Lane 188, Chin Mar Road, Sec. 3, Chang Hua, Taiwan

[21] Appl. No.: 596,625

[22] Filed: Feb. 5, 1996

[51] Int. Cl.[6] ..... A45B 25/14

[52] U.S. Cl. ..... 135/24; 135/22

[58] Field of Search ..... 135/22, 24, 25.4, 135/25.41, 15.1, 37, 20.3

[56] References Cited

U.S. PATENT DOCUMENTS

| | | | |
|---|---|---|---|
| 4,534,374 | 8/1985 | Day | 135/24 X |
| 4,548,222 | 10/1985 | Day | 135/24 |
| 4,989,625 | 2/1991 | Wu | 135/24 X |
| 5,036,872 | 8/1991 | Huang | 135/24 X |
| 5,144,969 | 9/1992 | Chou et al. | 135/22 |
| 5,458,144 | 10/1995 | Lavine | 135/24 |
| 5,492,140 | 2/1996 | Lin et al. | 135/24 |

*Primary Examiner*—Lanna Mai

*Attorney, Agent, or Firm*—Morton J. Rosenberg; David I. Klein

[57] ABSTRACT

The invention relates to a dual locking mechanism for umbrella handles that is provided inside an umbrella handle to engage the locating hole of an umbrella runner. Normally, the locking mechanism is used as the securing means to hold the runner in a position where the umbrella is close. If the umbrella will be kept in a storage place for a long duration, users can further press the runner into the handle to alter the umbrella to its most compact configuration thereby saving space and providing convenience of storage.

1 Claim, 7 Drawing Sheets

DUAL LOCKING MECHANISM FOR USE IN UMBRELLA HANDLES

BACKGROUND OF THE INVENTION

Generally one of the objects of the structural design of an umbrella is to provide a user convenience in opening, closing, and storing the umbrella. To facilitate carrying and storing an umbrella, the umbrella would take minimized volume as it is in a closed state. There have been many improvements made in umbrella frames to achieve the object but few of proposals about the rods are provided to further reduce the length of a closed umbrella.

In view of the aforementioned, the primary object of the invention is to provide an umbrella handle structure that is adaptable to umbrellas of various types and that comprises a locking mechanism to reduce the length of folded umbrellas by shortening the distance between the handle and the runner to the greatest extent thereby attaining the minimization of the length.

The structure, features, and advantages of the invention will now be described in detail with reference to the accompanying drawings.

DETAILED DESCRIPTION OF PREFERRED EMBODIMENTS

Figure 1:
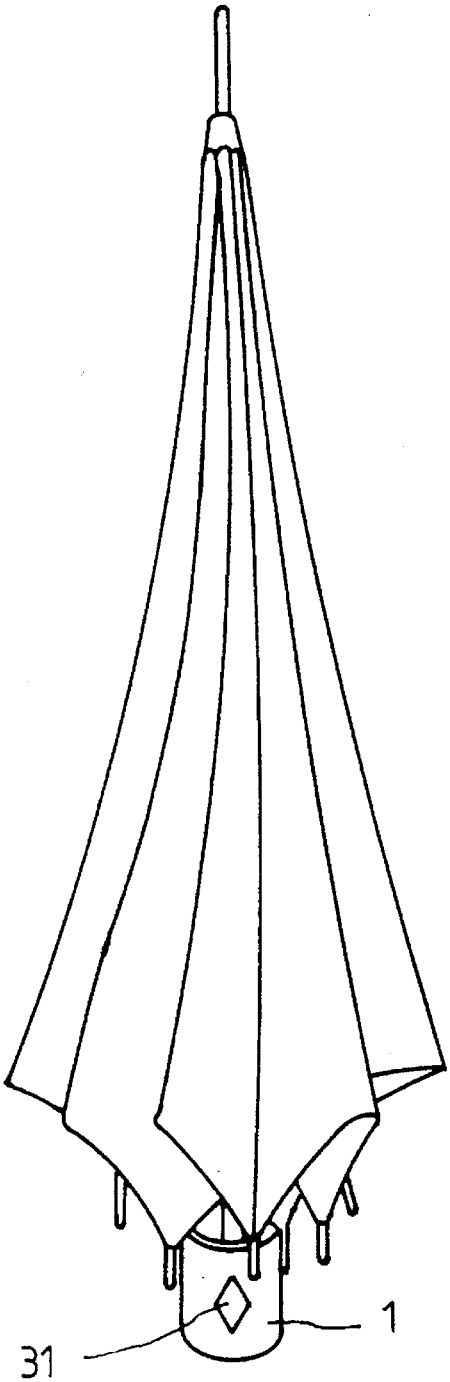
FIG. 1 is a perspective view showing the dual locking mechanism of the invention used in an umbrella handle.
Figure 2:
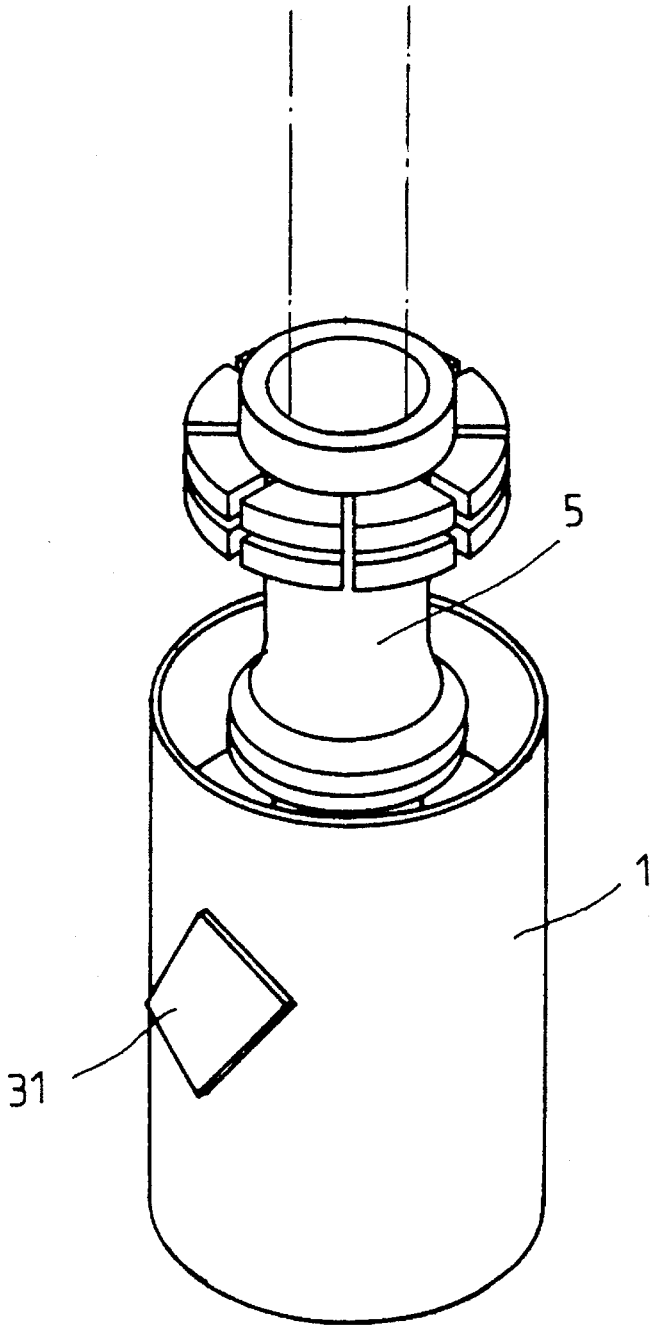
FIG. 2 is a perspective view illustrating the outer appearance of the umbrella handle of FIG. 1.
Figure 3:
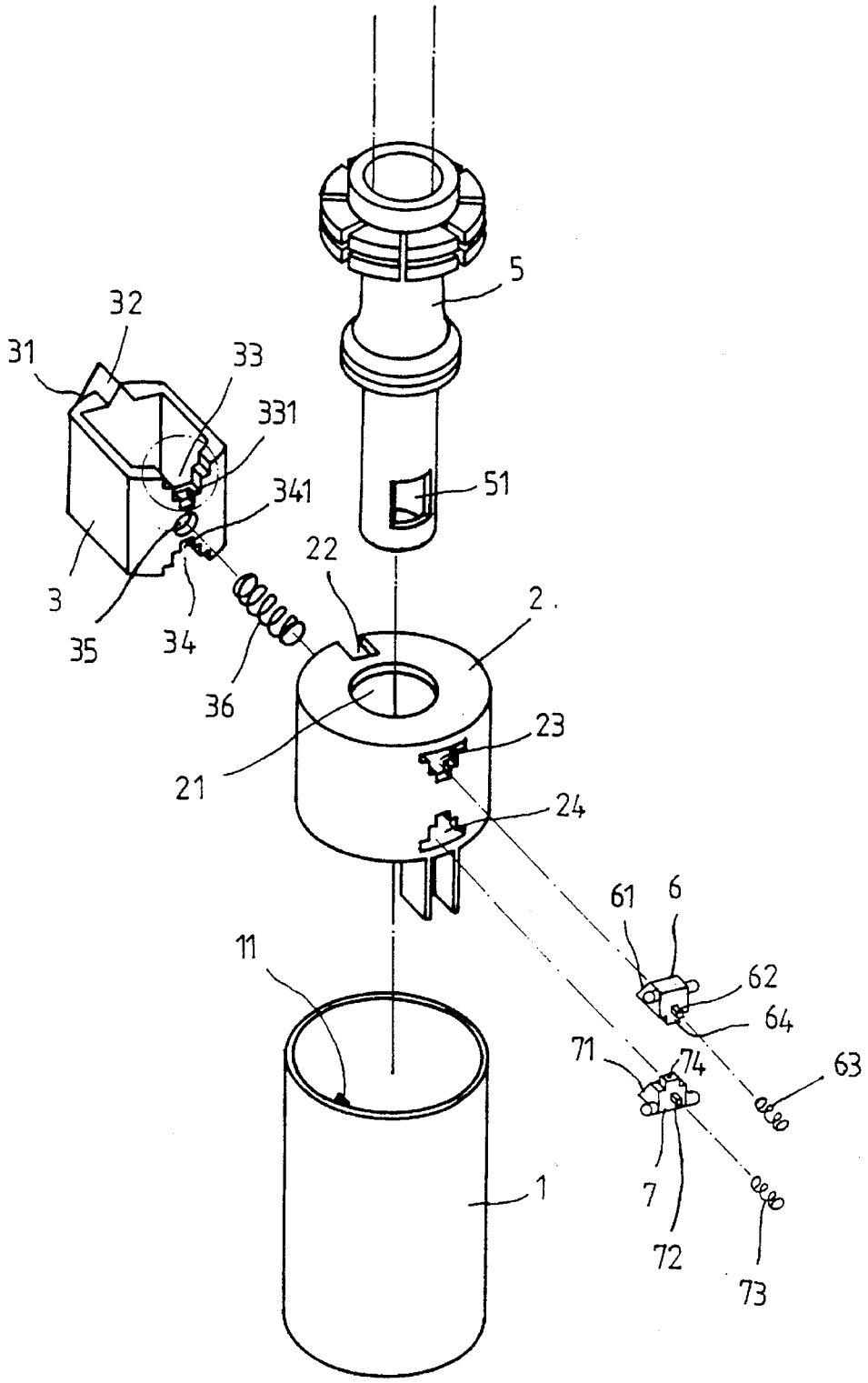
FIG. 3 is an exploded view of the umbrella handle shown in FIG. 2.

Now referring to the drawings, the improvements of the invention mainly consist in an umbrella handle (1) that can be adapted to umbrellas of various types. The umbrella handle (1) comprises a base (2) fixed inside thereof, a transversely slidable button (3), an umbrella rod (4) of which the bottom is secured inside the umbrella handle (1) and passes through the centers of the base (2) and the button (3), and a movable runner (5) with a locating hole (51) arranged on its cylindrical surface and embracing around the outer surface of the umbrella rod (4)

Figure 4:
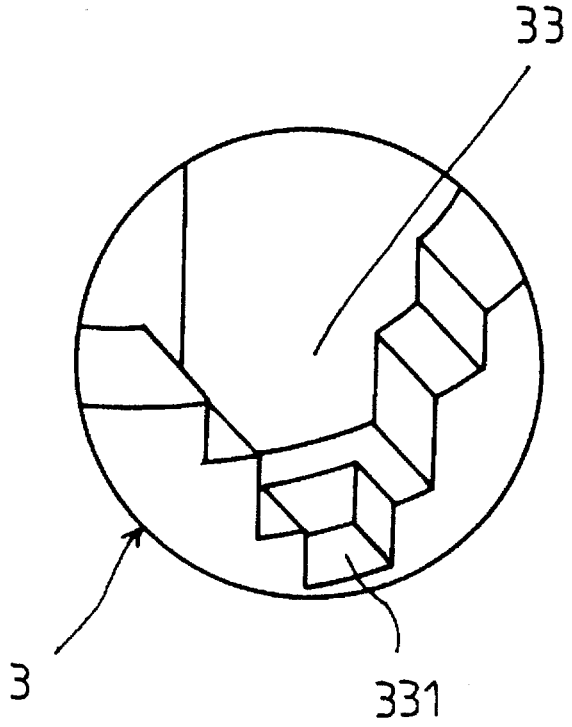
FIG. 4 is a partially enlarged view of the button shown in FIG. 3.

The umbrella handle (1) comprises a hole (11) on its side surface while the base (2) has an opening (21) disposed on the corresponding position and a slot (22) formed on the top of the base right above the opening (21), thereby allowing the button to be placed into the base. A raised portion (31) of the button (3) pierces through the opening (11) of the handle (1), with the top (32) of the raised portion (31) engaging with the slot (22). The button (3) is further provided with an upper stepped groove (33) and a lower stepped groove (34) on the side opposite to that side containing the raised portion (31), both grooves having recessed portions (331) and (334) respectively formed on the bottoms thereof as shown in FIG. 4. There is a circular cavity (35) formed in the middle of the area between the bottoms of the stepped grooves (33) and (34) for accommodating a spring (36) thereby providing an outward elastic pushing force. On the base (2) there are an upper and a lower guide groove (23) and (24) formed in the positions respectively corresponding to the upper and the lower stepped grooves (33) and (34) of the button (3). An upper and a lower locking element (6) and (7) are respectively situated in the guide grooves (23) and (24). Each locking element comprises one wedged end (61) and (71) and the other end provided with a stub (62) and (72) on which a spring (63) and (73) is mounted to furnish the locking element a resilient force toward the center of the base. The upper locking element (6) and the lower locking element (7) have, respectively on the bottom surface of the former and the top surface of the latter, a raised block (64) and (74) that engages with the stepped groove (331) and (341) of the button (3).

Figure 5:
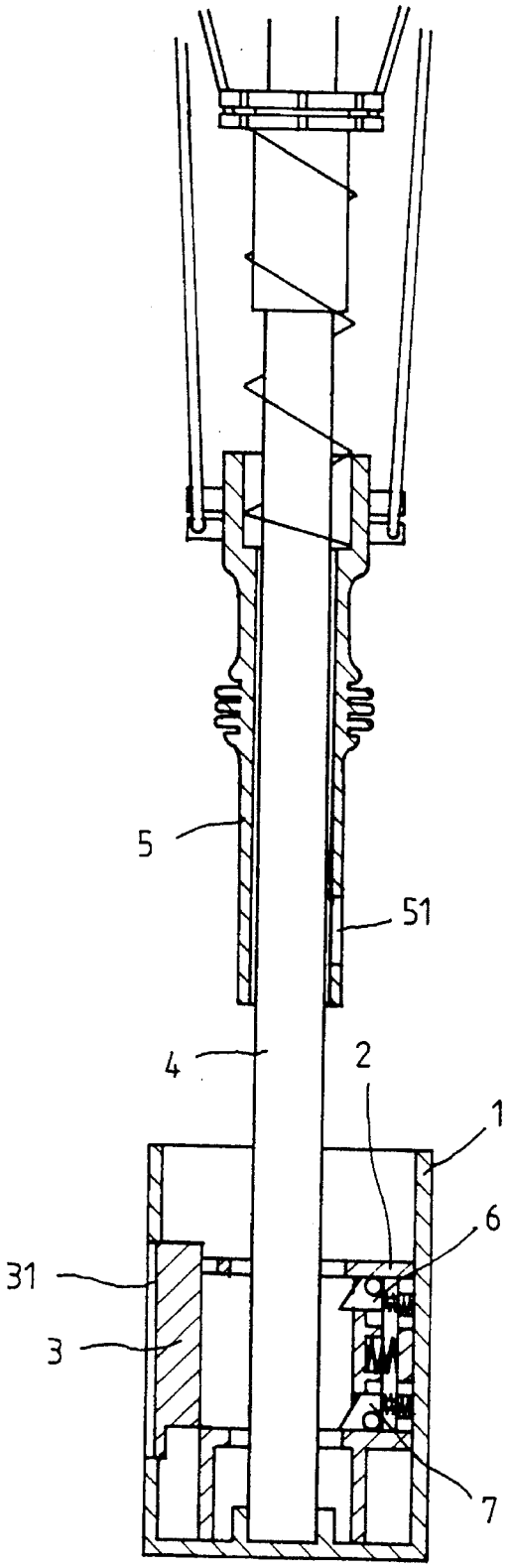
FIG. 5 is a cross-sectional view showing the dual locking mechanism affixed to an umbrella.
Figure 6:
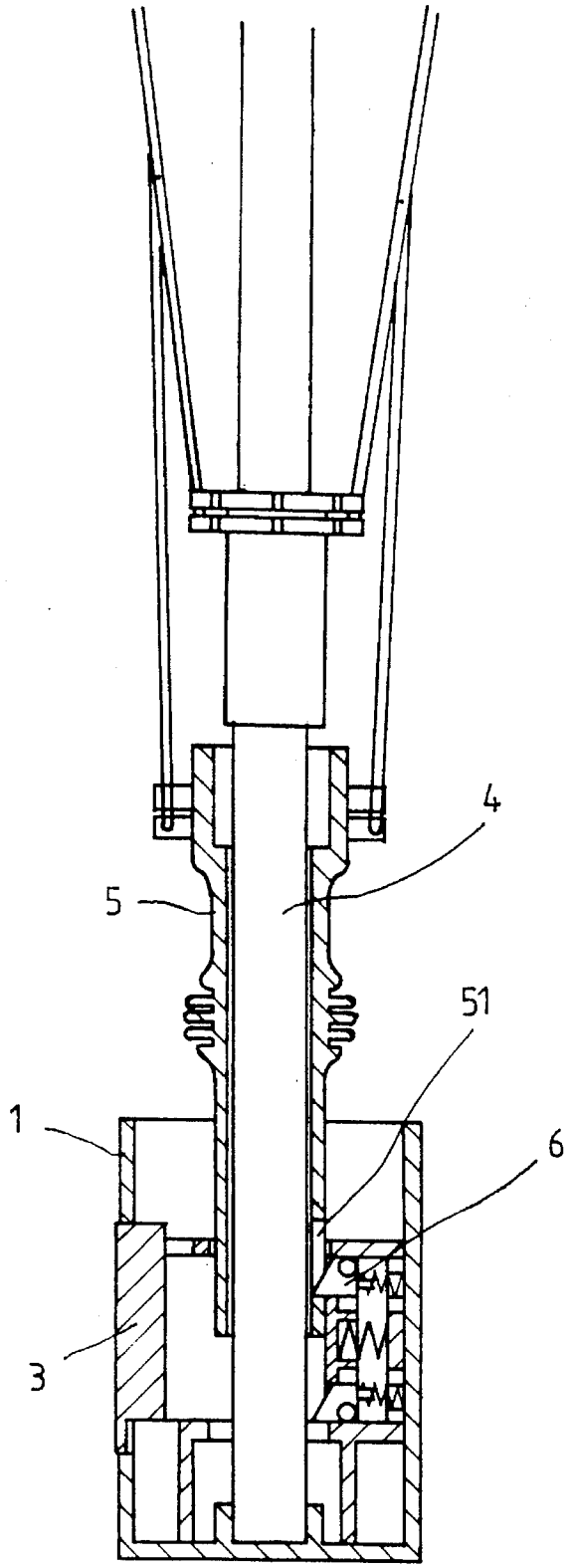
FIG. 6 is another cross-sectional view illustrating the dual locking mechanism in a normal locking position where the umbrella is kept closed.

Normally the umbrella according to the invention is closed by slightly pulling the runner (5) to move it from the position shown in FIG. 5 to the position shown in FIG. 6 so that the wedged end (61) of the locking element (6) slides into the locating hole (51). To open the umbrella, the user presses downwards the raised portion (31) of the button (3) to urge the button (3) to retract, which in turn makes the locking element (6) move back so that the locating hole (51) of the runner (5) escapes from the detention of the locking elements. Then the umbrella is opened.

Figure 7:
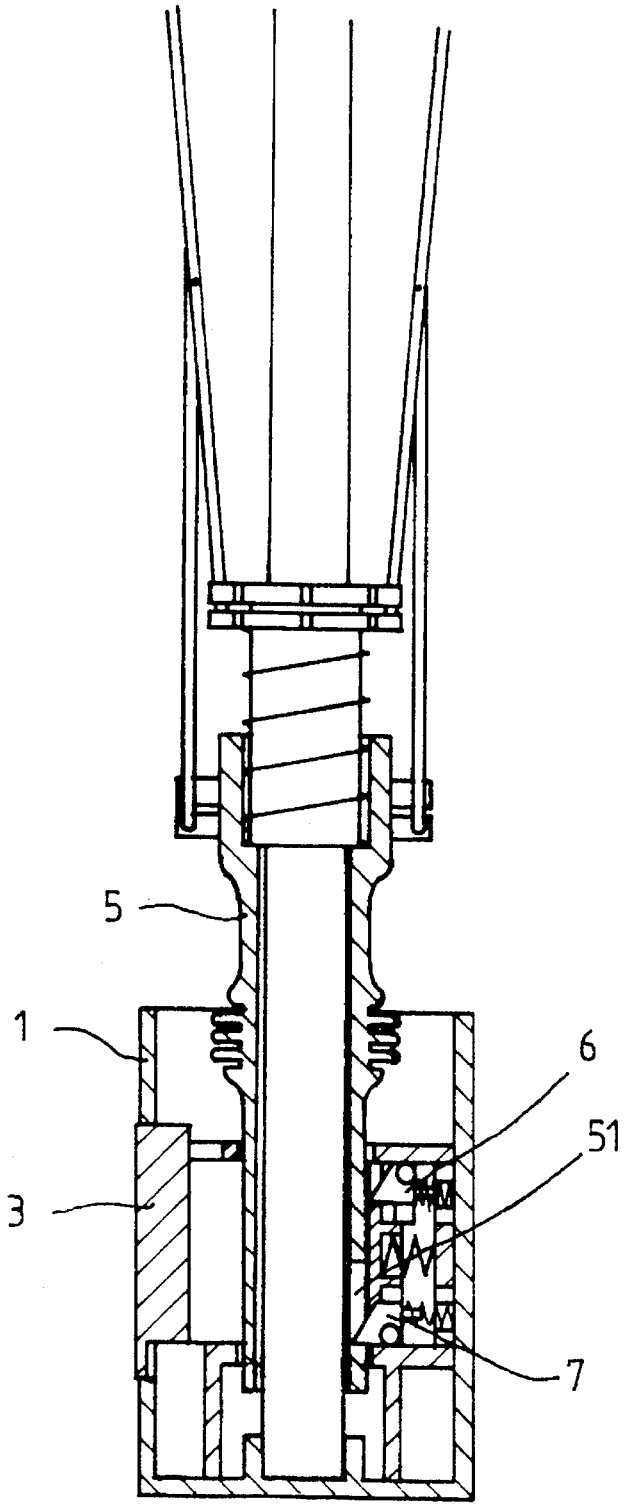
FIG. 7 is still another cross-sectional view showing the dual locking mechanism in a position where the umbrella is further shortened to its smallest length for facilitating carrying or storage.

If an umbrella will not be in use for a certain duration, then the umbrella can be further shortened by pulling the runner (5) farther until it reaches the lowest position shown in FIG. 7. In this case the distance between the runner (5) and the handle (1) is decreased to a greater extent, as a consequence of which the umbrella can achieve the most compact configuration. In addition, users can also open the umbrella by the same procedure as the aforementioned. When the user exerts a force on the raised portion (31), the upper and the lower locking elements (6) and (7) move away from the detention positions and release the runner (5) thereby the umbrella being opened. Then the button (3) and the locking elements (6) and (7) will restore to their original positions under the influence of the spring.

As described above, with the aids of the dual locking mechanism of the invention, an umbrella can reduce its length to the greatest extent after being closed, achieving the effects of saving space and facilitating carrying.

What is claimed is:

1. A dual locking mechanism of an umbrella handle, said handle being attached to the lower end of an umbrella rod, with a runner slidably embracing the outer surface of the rod, comprising:

a base and a transversely movable button disposed inside said umbrella handle, the base being provided with an opening;

said handle having a hole on its side surface and said base having an opening disposed at a corresponding position thereof and a slot formed on a top portion of said base above the opening, thereby allowing the button to be placed into the base;

said button having a raised portion on side thereof piercing through said opening of the handle with a top portion of the raised portion engaging with the slot of the base;

said button being further provided symmetrically with an upper stepped groove and a lower stepped groove on a side of said button opposite to the side thereof containing the raised portion, both grooves having a recessed portion respectively formed on bottom portions thereof, said button having a cavity formed between said grooves for accommodating a spring;

the base being provided an upper guide groove and a lower guide groove formed in positions respectively corresponding to the upper and the lower stepped grooves of the button;

an upper and a lower locking element being respectively situated in the guide grooves, and each locking element comprising one wedged end and an opposing end provided with a stub on which a spring is mounted to furnish the locking element a resilient force toward the center of the base;

said upper locking element and said lower locking element having, respectively on a bottom surface of the upper locking element and a top surface of the lower locking element, a raised block that engages with said stepped grooves of the button;

said dual locking mechanism holding the umbrella's runner in an upper position in a normal operation of closing the umbrella and fixing it in a lower position if further shortening is needed and releasing the runner by pressing said button.

* * * * *